US005860381A

United States Patent [19]

Fernandini

[11] Patent Number: 5,860,381

[45] Date of Patent: Jan. 19, 1999

[54] VARIABLE DRAFT TANDEM APPENDAGES FOR YACHTS

[76] Inventor: Alberto Alvarez-Calderon Fernandini, 410 Fern Glen, La Jolla, Calif. 92037

[21] Appl. No.: 788,218

[22] Filed: Jan. 25, 1997

Related U.S. Application Data

[60] Provisional application No. 60/010,653 Jan. 26, 1996.

[51] Int. Cl. [6] ..... B63B 3/38

[52] U.S. Cl. ..... 114/140; 114/141

[58] Field of Search ..... 114/39.1, 39.2, 114/121, 124, 127, 132, 274, 140, 271, 141, 143

[56] References Cited

U.S. PATENT DOCUMENTS

| | | | |
|---|---|---|---|
| 537,677 | 4/1895 | Beardsley et al. | 114/132 |
| 5,313,905 | 5/1994 | Calderon | 114/140 |
| 5,533,462 | 7/1996 | Parsons | 114/140 |

*Primary Examiner*—Stephen Avila

[57] ABSTRACT

12 Claims, 3 Drawing Sheets

VARIABLE DRAFT TANDEM APPENDAGES FOR YACHTS

1. FIELD OF INVENTION

This invention relates to yachts. More particularly, it pertains to structural, mechanical, hydrodynamic, gravitational, and control characteristics and sailing techniques for yachts having tandem foils supporting a ballast appendage having unique variable draft features and is referred to my provisional application Ser. No. 60/010,653 of Jan. 26, 1996, same title.

2. BACKGROUND

A conventional keel is a single appendage which provides in steady motion two functions: hydrodynamic side forces when sailed upwind at a leeway angle, and a righting moment when the boat heels, with gravity force acting on its lead content to provide righting moments against the heeling moment of the aerodynamic side force on the boat's sail. To maneuver, a conventional rudder yaws the boat with the rudder's adverse centrifugal force. This situation engages the keel's third function: it generates, by means of a change of its hydrodynamic angle of attack due to yaw, a larger centripetal force, required under Newton's second law for curvilinear motion.

Sailboats having keels with deep draft have large righting moments and a keel with a long span, which enable them to sail upwind efficiently, especially if the lead is concentrated in a bulb attached at the bottom of a slender fin, for example in FIG. 1. However, a keel with a deep draft cannot be used in shallow waters. Moreover, it restricts the boat's usage to a few deep harbors, and requires a hoist to launch the boat in deep harbors. Trucking is also impractical on many roads, because of lack of clearance under bridges.

For these reasons, a keel's draft is usually compromised according to harbor and water depth where the boat is sold and used, resulting in a keel that "is not too deep, and is not too light."

Some boats offer the buyer two fixed keel options, the one with less draft being called a "shoal" keel, having less span, and provides less stability unless it carries more weight. The buyer can choose one or the other, and they are not interchangeable.

A few boats offer retractable keels which are either telescopic, or swing rearwardly on a pivot at the hull's bottom.

In the telescopic arrangement, the keel is raised into the boat's cabin with a complex mechanism, usually pulleys. This could work well with a lead bulb, for example as in FIG. 2. Here the minimum draft is set by the rudder. The keel's retracted position is used for launching, beaching, trucking and sailing downwind. However, in practice, the telescopic complexities, including intrusion into the cabin, outweigh the benefits, and have not been commercially successful. For example, the early Hobie 33s with telescopic keel were discontinued in favor of the later Hobie 33s with a fixed keel.

Alternatively, a rectangular lead keel without a bulb (not to be confused with the centerboard of a day sailer) can swing rearwardly to decrease draft, as in FIG. 3, without intruding into the hull's cabin, with a pivotal mechanism much simpler than a telescope. However, the keel's center of gravity when deployed is too high for good upwind performance. If a lead bulb were used in this arrangement to lower the lead's center of gravity when deployed, it would penetrate when retracted into the hull if the bulb is installed trailing the keel. If the bulb is installed in a conventional manner on the keel's fin, as in FIG. 4, the bulb would protrude downwards from the retracted keel across-wise to the flow, as well as penetrate into the hull's cabin. Accordingly, swinging keels with a lead bulb attached at its bottom cannot be made to pivot at the keel's root.

Evidently, there is a need for a new and superior design of a variable draft appendage which provides a sailboat with the following characteristics:

Sails efficiently upwind with a lead bulb at deep draft;

Navigates safely in shallow waters with the appendage at a small draft;

Is mechanically simple and structurally sound; and

Permits practical launching and trailering.

The present invention, made prior to 1995 and subject to various revisions in 1995, formulates a unique variable draft tandem appendage design, which meets the above objectives and also provides additional unique sailing benefits.

This variable draft tandem is a radical departure from this writer's prior tandem appendage designs of fixed draft whose objectives were limited to (a) separate the hydrodynamic side force function, which is assigned entirely to two vertical foils without lead from the ballast function, which is assigned to a streamlined lead body suspended at the bottom of and between the two foils, together with (b) the use of movable flaps which moved in parallel motion to provide side forces without leeway, and also to provide maneuvering forces by opposite motion of the flaps. An example of such prior tandem design is shown in FIG. 5, similar to those in this writer's U.S. Pat. No. 5,313,905. But fixed draft tandems retain in full the compromised nature of any fixed draft appendage: "not too deep, not too light."

3. SUMMARY OF INVENTION

In his present invention, this writer has formulated a unique and powerful variable draft tandem appendages design (hereafter "VDT") of the type shown in FIG. 6, which has the following special characteristics: (a) it varies the draft of the tandem appendage by an unusually large amount using simple pivotal structural supports for angular motion fore and aft of the two foils about their roots while the hinged ballast body remains parallel to the local flow; and (b) has minimal draft when the foils are moved to a rearwardly inclined position with the ballast body next to the hull, with a shallow draft much smaller than shoal keels of monohulls, and so small as to be comparable to keeless Catamarans, while retaining all the lead ballast outside the hull without invading the boat's cabin. The VDT also achieves (c) powerful lateral stability when the lead torpedo is lowered to maximum depth when the foils are nearly vertical while (d) the VDT appendage provides a new kind of bending stiffness to the hull by supporting the lead weight by foils connected at two widely spaced articulated structural hinges at the hull's bottom, instead of supporting the lead weight at a single support at the middle of a hull, and (e) articulated foils provide great torsional stiffness to a long streamlined ballast body, which is very important at high water speed, by supporting that body by articulations at its ends, rather than at the body's middle attached to a narrow central foil.

These and other important benefits are specified in the objectives and detailed description of my invention and its summary statements.

4. OBJECTS OF THE INVENTION

The objects of my variable draft tandem ("VDT") appendage design are:

(a) A VDT in which fore and aft foils which have at their roots simple hinged supports connected to the hull; these two foils support, my means of simple hinges at their lower ends, an elongated streamlined lead ballast body therebetween;

(b) A VDT in which fore and aft angular motion of the foils relative to the hull changes substantially the draft of the appendage;

(c) A VDT in which the slender ballast body remains external to the hull when in the shallow draft position;

(d) A VDT in which the slender ballast body remains approximately parallel to the flow as the foils which support it undergo angular motion to change draft;

(e) A VDT which swings a slender lead bulb to change draft by pivotal motion of the two foils about two separate widely spaced hinges mounted on the hull away from the hull's midbody, whereby the bending of the hull is decreased.

(f) A VDT in which a slender ballast body is supported adjacent its ends, thereby preventing torsional oscillation about a yaw axis when sailing at high speed.

(g) A VDT in which the foils are attached at widely separated points of the hull, to reduce local appendage loads on the hull, while increasing its stiffness in bending.

(h) A VDT in which the slender ballast body is adjacent and approximately parallel to the bottom of the hull's when fully retracted with the VDT configured for minimum draft forward of the retracted appendages, enabling beaching the bow of the hull on shallow beaches, and providing greatly improved draft when deployed forwardly to sail upwind in deep waters.

(i) A VDT in which the center of lateral hydrodynamic resistance is determined by the angular position of the foils, relative to the sail plan, with the hydrodynamic center being shifted fore and aft in the deep draft range, so that the hydrodynamic side force on the foils, which opposes and balances the sails' aerodynamic side force, are placed approximately collinear when projected in the waterplane for various points of sail and wind strength, without need to compromise sail shape or to compromise foil performance by differential flap setting to balance the boat in yaw;

(j) A VDT in which yawing and turning is accomplished by shifting the foils and, hence the hydrodynamic side force, fore and aft relative to the aerodynamic side force of the sails and the hydrodynamic center of the hull proper.

(k) A VDT in which a position of maximum ballast draft is used for sailing with aerodynamic loading in both the forward and rearward sails, and a partially swept-back foil position of reduced ballast draft used for sailing in shallow waters, with steering accomplished by change of the angular position of the foils fore and aft, and propulsion is attained by aerodynamic loading principally on the rearward sail.

(l) A VDT in which the ballast position of maximum draft is used for sailing upwind with principal aerodynamic sail force component being in a lateral direction, with the vertical force component on the lead ballast opposing the heeling force of the sail, while steering may be accomplished by differential forces of the foils, and a swept back foil position which moves the ballast rearward when sailing with a significant aerodynamic sail force component directed forwardly, whereby the pitch-up torque induced by the rearward ballast position opposes the nose-down pitch torque due to the forward component of the sail's force, with steering accomplished by differential lateral forces on the foils.

(m) A VDT which uses a maximum draft when sailing in deep waters steering with differential side forces on the foils with a separate retractable rudder being retracted out of the water to reduce drag, and which in shallow water has the ballast in shallow draft position, steering with the retractable rudder deployed to engage the water below the hull.

(n) A VDT in which rearward sweep of the foils can be selectively used to disengage kelp and weeds from the appendages.

(o) A VDT in which damped angular rearward motion of the foils is provided to damp out and minimize the structural effects of grounding or collision of the appendage.

(p) A VDT in which the shape of the ballast body has a relatively flat, or concave upwards, upper surface, whereby the ballast body can be moved contiguous to hull at the minimum draft position.

(q) A VDT in which a feathering propeller is mounted at one end of the slender lead body.

(r) A VDT in which a propeller mounted on the ballast body can swing laterally to provide steering when needed.

(s) A VDT in which hinged means are provided on fixed stub wings, located fore and aft on hull, to support the roots of the foils having fore-and-aft angular freedom, but lateral restraint to provide righting moments, and hinged means are provided at the foil tips to engage and support a slender ballast body therebetween.

(t) A VDT in which hydraulic means are provided between foils and hull to change the fore-and-aft inclination (sweep) of the foils and thus change the draft to the foils and ballast body.

5. BRIEF DESCRIPTION OF DRAWINGS

FIG. 1 shows a boat with a conventional fixed fin having a ballast bulb.

FIGS. 2 and 3 show variable draft improvements of conventional keels using telescopic and pivoted mechanisms, respectively.

FIG. 4 shows a variable draft obviously developed from prior art in which a conventional fin keel with a ballast bulb, when retracted using a variable draft pivot mechanism at its root, causes the bulb to invade the hull; also its retracted position is hydrodynamically inoperative and generates substantial draft anyway.

FIG. 5 shows a sailboat with tandem appendage.

Figure 9:
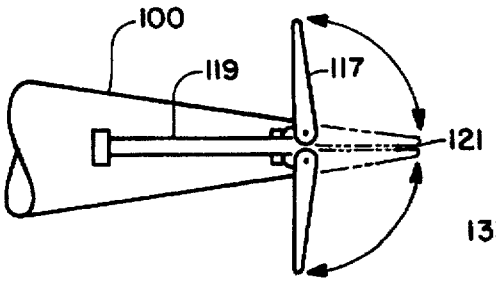

FIG. 9 pertains to special auxiliary propulsion for a VDT yacht.

Figure 10:
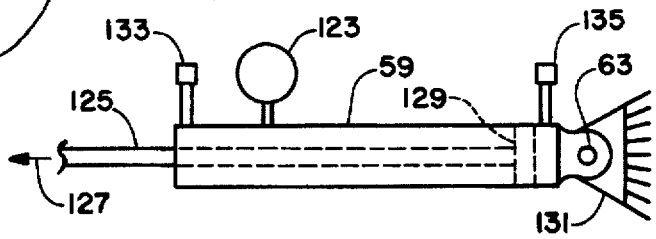

FIG. 10 shows hydraulic and damping features of VDT's retraction mechanism.

6. DETAILED DESCRIPTION OF PREFERRED EMBODIMENTS

Figure 1:
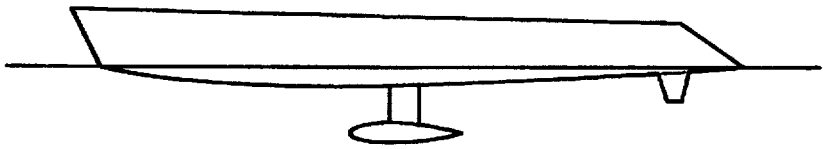
FIG. 1 (PRIOR ART)
FIGS. 1 to 5 are prior art.
Figure 2:
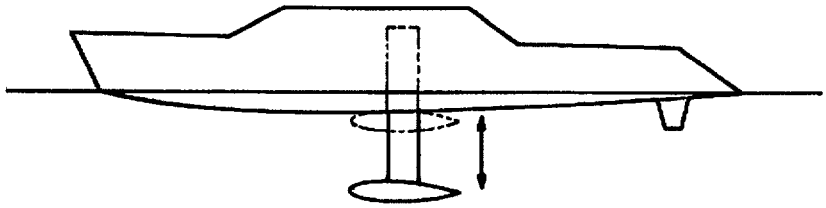
FIG. 2 (PRIOR ART)
Figure 3:
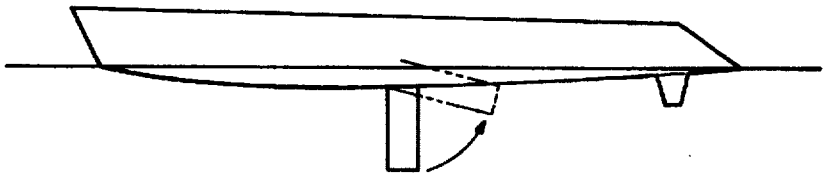
FIG. 3 (PRIOR ART)
Figure 4:
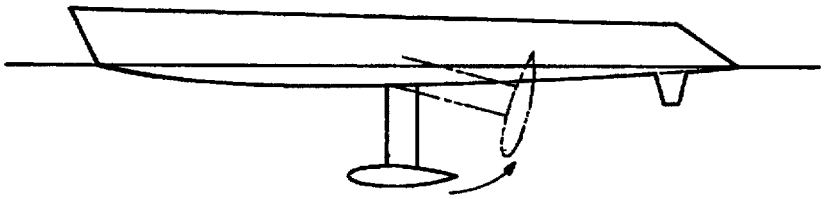
FIG. 4 (PRIOR ART)
Figure 5:
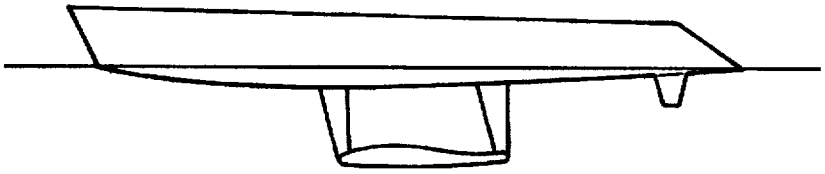
FIG. 5 (PRIOR ART)
Figure 6:
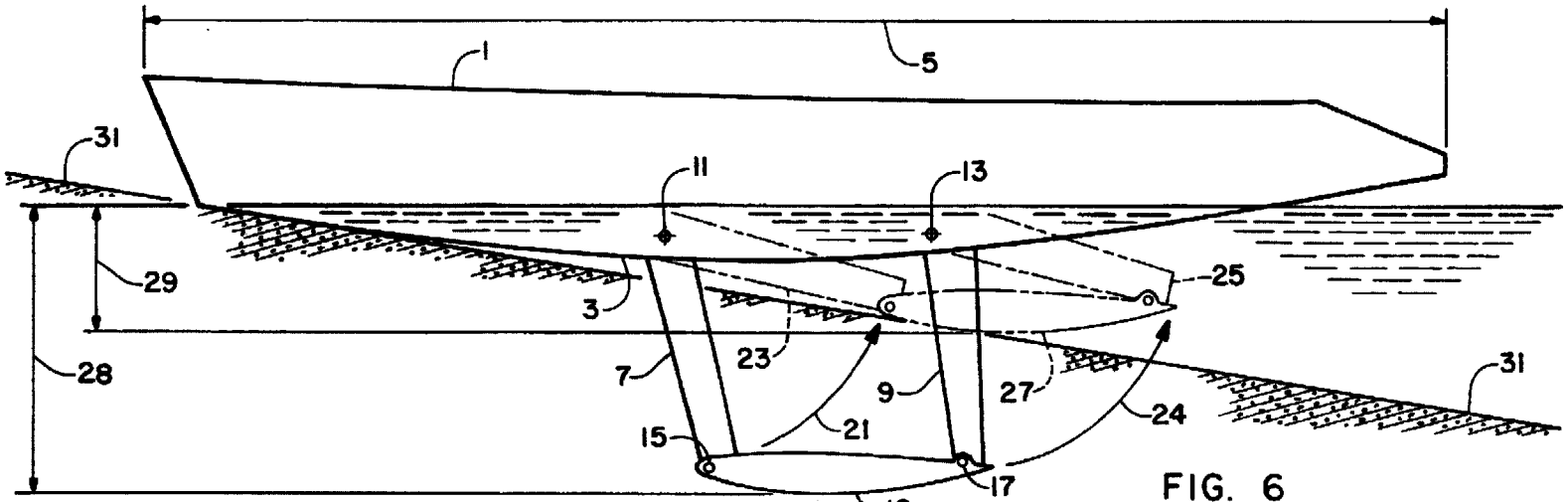
FIGS. 6 & 7 show preferred embodiments of this writer's unique variable draft tandem (VDT) appendage.

FIG. 6 shows the hull 1 of a sailboat having a bilge or lower portion 3 and an overall length 5. At the hull's lower portion, there are attached forward foil 7 and rear foil 9 with structural pivots 11 and 12 at their roots, respectively. At their lower ends, foils 7 and 9 support, at structural pivots 15 and 17, respectively, a streamlined lead ballast bulb or torpedo 19. The foil and ballast components described above comprise the variable draft tandem (VDT) appendage in its deployed position for maximum righting moment, used when sailing upwind and in a close reach. The VDT appendage is adapted to pivot rearwardly along tip paths 21 and 23 of the foils, to a minimum draft or retracted position shown in dashed lines in which the front and rear foils are identified as 23 and 24, respectively, and the lead ballast as 27. This position can be used for sailing downwind, and for motion of the yacht in shallow water with reduced sail, or under propeller power. It is also essential for launching the yacht in shallow harbors, or trailering the yacht from a car, or for using ramps for launching the yacht into shallow water.

The very large change of draft which the VDT provides to the yacht is seen by comparing the deep draft 28 corresponding to deployed maximum righting moment position, with the very shallow small draft 29 corresponding to the retracted position. In the drawing, the maximum draft used in sailing is 2.6 times the minimum draft used in shallow waters, or conversely, the draft for shallow water is only 38% of the draft for deep waters. For example, with a hull length set at 94 feet (28.65M), the sailing draft is 18 feet (5.5M) and the shallow water draft is only 7 feet (2.15M).

A special feature of the VDT appendage is the favorable beaching capability when retracted. This is evident by the very shallow angle with the line 31 passing through the hull's bow and the retracted ballast bulb. This line shows that a yacht with a VDT appendage retracted can be beached bow-first on sandy beach, a special benefit which makes a VDT monohull competitive with the beaching benefits of a multihull boat.

Figure 7:
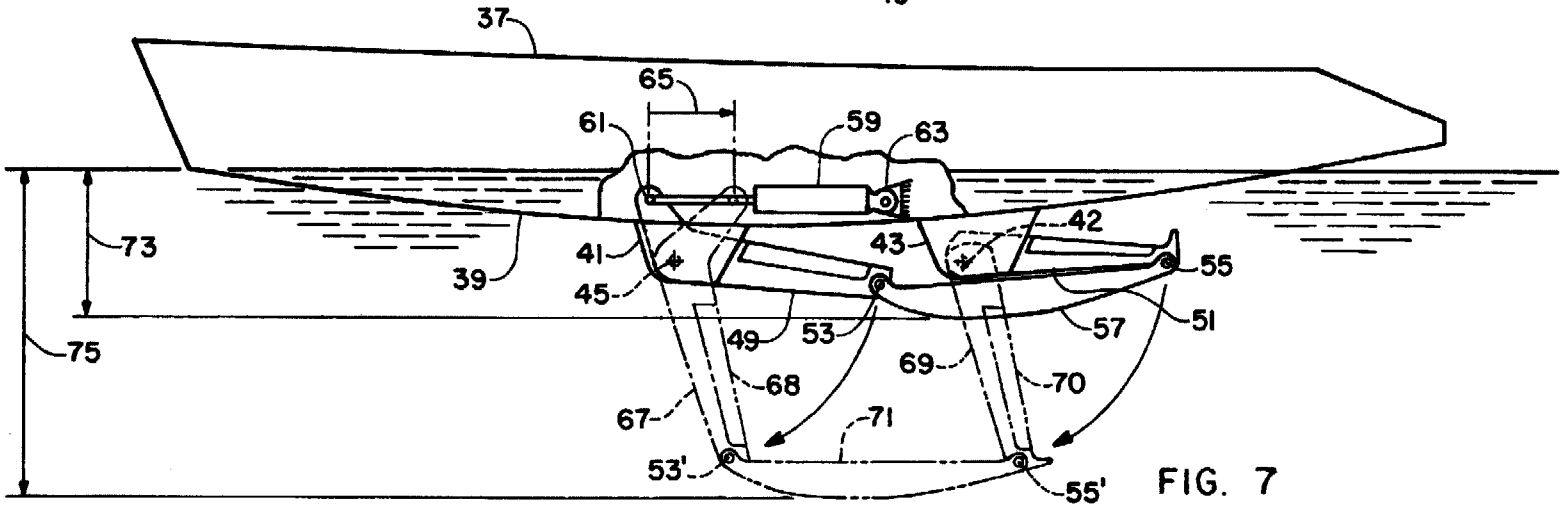

FIG. 7 shows the hull 37 of a sailing yacht having a bottom surface 39 equipped with downwardly protruding forward and aft streamlined wing stubs 41 and 43 respectively. These stubs support at articulations 45 and 47, the roots of forward and rear foils 49 and 51, respectively, shown in the shallow-draft or retracted position. At the tip of the foils, there are provided fore and aft articulations 53 and 55 respectively, supporting therebetween ballast body 57, also in the retracted position. The top of the ballast body is shaped to reduce the combined draft of bodies 57 and 51.

Actuation of the sweep angle of VDT is made by one or more hydraulic cylinders connected to a foil and the hull. In FIG. 7, cylinder 59 is connected to an arm of forward foil 49 at pin 61, and to a hull support at pin 63. Retraction of the piston moves the piston's rod to the rear by stroke 65, which generates angular motion of foils 49 and 51 to the deployed or maximum-draft position 67 and 69 respectively, with ballast body in position 71. In this position, flaps 68 and 70 can provide side force control by parallel flap motion without leeway, or turn the boat by opposite motion of the flaps, their control being made by flexible hydraulic lines passing through or contiguous to pins 45 and 43, so control remains hydraulically active regardless of sweep of foils. Alternatively, control cables or rods can be inserted concentric to pins 45 and 43 which should be hollow for that purpose.

The stub wing supports 41 and 43 offer important practical advantages by keeping retracted foils 49 and 51 outside the hull's bottom with better structural continuity of the hull, while allowing the hull's bilge area to house actuation cylinder below the hull's floor area. Alternatively, piston 59 can be placed below hull 39, between downstream end of foil 49 and wing stub 43, whereby the entire VDT and its actuation system remains outside hull 39, which is important for retrofit applications.

Also in FIG. 7, the cantilevered length of the foils in the deployed position is decreased by the length of the stubs, which enable the structural use of a deeper draft 75, which scaled on a 94 foot boat length is 21 feet. The change of draft when using stub wings is still very large, from 73 in shallow water, launching, trailering and beaching, to 75 for sailing in deep waters.

Figure 8:
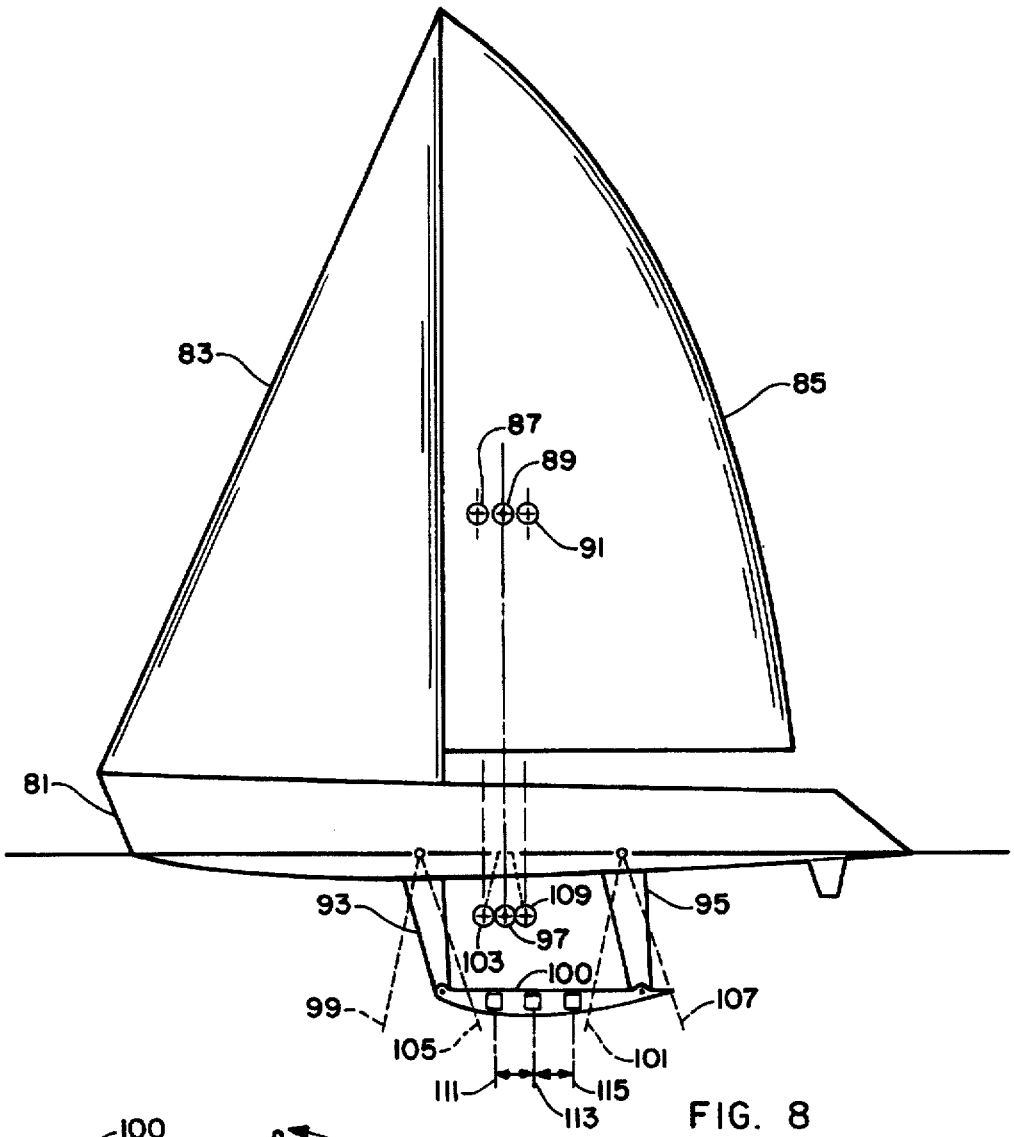
FIG. 8 shows the special cooperation which VDT provides with changing sail forces.

FIG. 8 shows the unique cooperation which this writer's VDT appendage provides with a yacht's sail, enabling also a new and unique sailing technique for VDT boats. Specifically, the yacht's hull 81 is powered by aerodynamic head sail 83 and main sail 85. The sail's combined projected center of effort is shown as 87 close-hauled, 89 close-reaching, and 91 beam or power reaching. A conventional boat uses changing rudder positions to trim change of aerodynamic center position and effects of aerodynamic yaw as point of sail is changed. In contrast, the VDT can use change of foil's angular inclination fore and aft to trim change of aerodynamic loads without need of a rudder. In FIG. 8, the foils in position 93 and 95 combine to provide hydrodynamic center 97 for yaw equilibrium close reaching. For close-hauled sailing, foils are angled forwardly to lines 99 and 101, to provide a forward combined hydrodynamic center 103 below aerodynamic center 87. The foils are moved rearwardly to positions 105 and 107 to provide hydrodynamic center 109 below aerodynamic center 91 for power reaching. The hydrodynamic changes thus described permit optimum setting of the sails for maximum thrust, also without the added drag and dangers of loading or overloading a conventional rudder which may "stall out" on a power reach, precipitating a dangerous "broach." While the terms aerodynamic center and hydrodynamic center have been used because they are usual in naval architecture, design consideration should be given to the collinearity of resultant hydrodynamic and aerodynamic vectors projected in waterplane.

A special additional cooperation is provided by the VDT appendages in pitch. As the aerodynamic center shifts from close-hauled 87, to close-reach 89, to power-reach 91, the sail's vector has a forward component of thrust which increases and normally pitches the yacht nose down. This can present steering and safety problems. In contrast, the VDT's ballast body 100 has a CG position which shifts rearwardly as the foils are inclined from forward to rear to synchronize the foil's hydrodynamic center with the sail's aerodynamic center, as described earlier. This results in an increase of pitch up as the ballast's center of gravity, shown by squares in the ballast's contour, moves from station 111 close-hauled to station 113 close-reaching to station 115 power-reaching. As a consequence, the increase of aerodynamic nose-down torques from the sails is countered with the pitch-up torque from gravitational forces acting on the rearwardly moving ballast, greatly reducing or eliminating pitch-down.

Summarizing FIG. 8, this writer's VDT appendages have special and unique features which enable, with proper design, near-perfect yaw and pitch equilibrium as function of properly controlled angular motion of the foils provided by the VDT mechanism.

FIG. 9 shows a unique installation of a folding propeller 117 at the rear of ballast body 100 of FIG. 8. The propeller is driven by shaft 119 and folds back to position 121 when sailing. The propeller's shaft can be tilted to one side to provide lateral forces for steering.

FIG. 10 shows a special safety feature which damps out the shock of accidental collision of the front foil of VDT with obstacles or a beach. Specifically, hydraulic cylinder 59, from FIG. 7, is shown with piston 129 in its retracted position corresponding to deployed foils. The cylinder is equipped with a lateral high pressure gas chamber 123. When impact occurs on the front foil in the deployed deep-draft position, for example 67 in FIG. 7, sudden tension 127 appears on rod 125, which tends to move piston to the left in FIG. 10. Now hydraulic fluid is incompressible, and this would cause a structural shock on hull support 131 to which pin 63 is connected. This shock is diminished and made soft by relief valve 135, and also by nitrogen gas chamber 123. The single or combined effect of these devices is to reduce structural loads on hull 81 and on the VDT appendages in the event of collision of the forward foil.

There are variations and improvements for this writer's VDT appendage invention which are unique. For example, rearward foil motion can be used to release kelp from the appendages, or to sail at reduced sail power, for example using foil position pair 105–107 to sail with main sail only, or foil positions 99–101 of FIG. 8 to sail with head sail 83 only. These benefits, and those of FIG. 8, provide for new methods of sailing. Also, the hydraulic cylinder can be replaced by ballscrews or jackscrews. These and other features can be used in this writer's invention without deporting from its spirit.

Certain features of VDT are important, as they can increase the safety of the boat, for example: structural damage from appendage collisions is diminished by dampers, not feasible in fixed keels; a capability of powerful yaw trim by changing sweep to correspond to changes of sail loads with points of sail is provided, without overloading a rudder; the capability of pitch trim stabilization with various points of sail, avoiding sinking of the bow, is also provided by change of sweep of foils; also a large reduction of hinge and hull loads is indicated in a VDT, by having two ballast load discharge positions. However, all these features can be compromised, annulled, or even reversed by improper structural, mechanical, hydraulic, or aero-hydrodynamic design. Thus, the safety of VDT in any one specific boat embodiment depends entirely on the competence of the naval architect's design of the VDT appendage, the adequacy of the sailing criteria of the skipper, the reliability of the maintenance system of the VDT boat, adequacy of navigation, compatibility of type of hull shape utilized, and many other factors which are obviously outside the scope and province of these specifications and drawings.

It is helpful to summarize here the principal characteristics of the VDT in the statements listed below, which I claim:

1. A yacht with a hull which has a sail with an aerodynamic side force vector which translates according to point of sail, with front and rear foils combined with the hull providing a hydrodynamic side force vector, with the angle of the foils to the hull being adapted to be moved fore and aft to obtain approximate collinearity of the projection of the aerodynamic and hydrodynamic vectors in the waterplane; and with a slender ballast body suspended between tips of said foils to shift CG rearwards when sail vector points forward.

2. A sailing yacht with a VDT, comprising a hull having an underbody, a front foil articulated at its root portion to a first portion of said underbody; a rear foil articulated at its root portion to a second portion of said underbody; an elongated ballast body having a forward portion articulated on a tip portion of said front foil and having a rearward ballast portion articulated on a tip portion of said rearward foil, said yacht and VDT being further defined in that said foils are adapted to be moved from an extended position at a substantial angle to said hull, in which the tips of said foils and said ballast have a deep draft, and a retracted position in which said foils are inclined to said hull at a greatly reduced angle, and in which said ballast and said tips of said foils are at a reduced draft.

3. The structure of claim 2 further characterized in that said foils have trailing edge flaps which is capable of turning in opposite directions to steer said yacht, and in that control means to move said flap are routed, in the vicinity of said root articulation of said foil, contiguous to said root articulation, whereby control of said flap can be maintained for various angles of said foils relative to said hull.

4. The yacht of claim 2 further characterized in that yawing and turning is accomplished by shifting its foils, and hence the location of their hydrodynamic side force, fore and aft relative to the aerodynamic center of the sails, and relative to the hydrodynamic center of the hull, whereby steering of the yacht is accomplished.

5. The sailing yacht of claim 2 further characterized in that said underbody has said first portion projecting downwardly with the shape of a first stub wing at the bottom of which the root portion of said front foil is articulated, and in that said underbody has said second portion to the rear of said first portion projecting downwardly with the shape of a second stub wing at the bottom of which the root portion of said rear foil is articulated, with said elongated ballast body being located below and substantially external to said underbody when said foils are in said retracted position.

6. The structure of claim 5 in which the downward span of said stub wings is no less than the chord of the root portion of said foils which is located to the rear of said articulations when said foils are in said deep draft position, and with said foils being located below and external to said underbody when said foils are in said retracted position.

7. The yacht of claim 2 characterized further in that a folding propulsive propeller is installed at the rear of said elongated ballast body to provide propulsive forces to move said yacht.

8. The yacht of claim 7 further characterized in that a retractable rudder is provided to the rear of said propeller, with said rudder being deployed downwards when said foils are in said retracted position, to provide when turned left and right rudder forces which are augmented by the presence of the propeller's slipstream, and with said rudder being retracted to reduce drag when said foils are in said deep draft position.

9. The yacht of claim 7 in which a shaft portion supporting said propeller can be oriented right or left to steer and control said yacht when said propulsive propeller is operative.

10. A sailing yacht with a VDT, comprising a hull having an underbody, a front foil articulated at its root portion to a first portion of said underbody; a rear foil articulated at its root position to a second portion of said underbody; an elongated ballast body having a forward portion articulated on a tip portion of said front foil, and having a rearward ballast portion articulated on a tip portion of said rearward foil, said yacht and VDT being further defined in that said foils are adapted to be moved from an extended position at a substantial angle to said hull, in which the tips of said foils and said ballast have a deep draft, and a retracted position in which said foils are inclined to said hull at a greatly reduced angle, and in which said ballast and said tips of said foils are at a reduced draft, and in that powered means are provided which move said ballast body between a deep draft position and a reduced draft position.

11. The structure of claim 10, further characterized in that said powered means comprise a hydraulic piston within a hydraulic cylinder, with said piston being capable of moving said foils and ballast from a deep draft position in a rearward direction; said cylinder being further characterized in having pressure relief means which, upon accidental impact of an obstruction on said foil, are engaged to reduce the hydraulic pressure, thereby permitting motion of said piston relative to said cylinder, and of said foil and ballast body rearwardly relative to said hull upon said accidental impact, whereby structural loads on said hull and on said VDT are decreased and damped.

12. A rudderless sailing yacht with a VDT, comprising a hull having an underbody, a front foil articulated at its root portion to a first portion of said underbody; a rear foil articulated at its root portion to a second portion of said underbody; an elongated ballast body having a forward portion articulated on a tip portion of said front foil and having a rearward ballast portion articulated on a tip portion of said rearward foil, said yacht and VDT being further defined in that said foils are adapted to be moved from an extended position at a substantial angle to said hull, in which the tips of said foils and said ballast have a deep draft, and a retracted position in which said foils are inclined to said hull at a greatly reduced angle, and in which said ballast and said tips of said foils are at a reduced draft.

* * * * *